US005947126A

United States Patent [19]

Wilson et al.

[11] Patent Number: 5,947,126

[45] Date of Patent: Sep. 7, 1999

[54] ENVIRONMENTALLY DISINTEGRATABLE TOBACCO SMOKE FILTER ROD

[75] Inventors: Steven A. Wilson; James E. Harris, both of Kingsport, Tenn.

[73] Assignee: Eastman Chemical Co., Kingsport, Tenn.

[21] Appl. No.: 08/864,949

[22] Filed: May 29, 1997

[51] Int. Cl.[6] ..... A24B 15/00; A24B 15/10; A24B 15/18; A24D 3/04

[52] U.S. Cl. ..... 131/331; 131/332; 131/340; 131/343; 131/345

[58] Field of Search ..... 731/331, 332, 731/333, 334, 340, 343, 345

[56] References Cited

U.S. PATENT DOCUMENTS

| | | | |
|---|---|---|---|
| 2,794,239 | 6/1957 | Crawford et al. | 206/417 |
| 2,829,027 | 4/1958 | Raynolds et al. | 264/177.13 |
| 2,905,050 | 9/1959 | Keifer et al. | 131/342 |
| 2,953,838 | 9/1960 | Crawford et al. | 428/369 |
| 3,017,309 | 1/1962 | Crawford et al. | 156/161 |
| 3,768,489 | 10/1973 | Kiefer et al. | 131/261 B |
| 4,907,609 | 3/1990 | Cohen et al. | 131/332 |
| 5,678,577 | 10/1997 | Matsumura et al. | 131/331 |
| 5,706,833 | 1/1998 | Tsugaya et al. | 131/332 |
| 5,758,669 | 6/1998 | Taniguchi et al. | 131/340 |

OTHER PUBLICATIONS

"Environmentally Disintegratable Cigarette Filters", *Research Disclosure Journal,* No. 38625, p. 374, Jun. 1996.

*Primary Examiner*—James Derrington
*Assistant Examiner*—Jacqueline A. Ruller
*Attorney, Agent, or Firm*—Staas & Halsey

[57] ABSTRACT

A bundle of cellulose acetate fibers is bonded together with a water-soluble fiber-to-fiber bonding agent. The water-soluble fiber-to-fiber bonding agent may include 60–99 wt. % of a water-soluble binder and 40–1 wt. % of a plasticizer. As to the specific components, the water-soluble fiber-to-fiber bonding agent may be a mixture of a water-soluble polymer and glycerol triacetate. The bonded fibers are wrapped in a paper having opposing ends secured together with a water-soluble plug wrap adhesive. A plurality of cuts are made to extend more than one half way through the bundle wrapped fibers. The plurality of cuts may extend more than one half way through the bundle without extending completely through the bundle and may extend from a plurality of different directions. Further, the bundle of wrapped fibers may have cuts extending more than one half way though the bundle from a first direction, and also have a plurality of cuts extending less than one half way through the bundle from a second direction, different than the first direction. If cuts are made from different directions, there is a distance between adjacent cuts made from that direction, and this distance should be in the range of 2 to 7 mm.

23 Claims, 1 Drawing Sheet

ENVIRONMENTALLY DISINTEGRATABLE TOBACCO SMOKE FILTER ROD

BACKGROUND OF THE INVENTION

1. Field of the Invention

The present invention relates in general to rods of filter material and more specifically, to environmentally disintegratable cellulose acetate rods for filtering tobacco smoke.

2. Description of the Related Art

After a cigarette is consumed, it is often discarded improperly. Conventional tobacco smoke filters can require years to disintegrate and degrade when discarded, due to the highly entangled nature of the fibers, solvent bonding between the fibers, and the slow degradability of the cellose acetate polymer. It has been reported that tobacco smoke filters are the leading item collected during beach clean-ups. In fact, legislation has been proposed which would ban cigarettes which are not biodegradable due to the mistaken perception that filters do not degrade.

SUMMARY OF THE INVENTION

Accordingly, it is an object of the present invention to provide a tobacco smoke filter which will disintegrate and degrade in a short period of time.

It is a more specific object of the present invention to provide a tobacco smoke filter in which the cellulose acetate fibers will release from the tobacco smoke filter shortly after the cigarette is discarded.

It is a further object of the invention to provide an environmentally disintegratable filter rod having substantially the same smoke filtration properties as conventional filter rods, without greatly increasing the cost of the filter rod.

It is a further object of the present invention to provide a tobacco smoke filter rod and method for producing same in which a bundle of cellulose acetate fibers are bonded together with a water-soluble fiber-to-fiber bonding agent. The water-soluble fiber-to-fiber bonding agent may include 60–99 wt. % of a water-soluble binder and 40–1 wt. % of a plasticizer. As to the specific components, the water-soluble fiber-to-fiber bonding agent may be a mixture of a water-soluble polymer and glycerol triacetate. The bonded fibers are wrapped in a paper having opposing ends secured together with a water-soluble plug wrap adhesive. A plurality of cuts are made to extend more than one half way through the bundle of wrapped fibers. The plurality of cuts may extend more than one half way through the bundle without extending completely through the bundle and may extend from a plurality of different directions. Further, the bundle of wrapped fibers may have cuts extending more than one half way though the bundle from a first direction, and also have a plurality of cuts extending less than one half way through the bundle from a second direction, different than the first direction. If cuts are made from different directions, there is a distance between adjacent cuts made from that direction, and this distance should be in the range of 2 to 7 mm. In addition, the pattern of cuts (cut created length) must allow substantially all or 95% of the filter's fibers to be cut equal to or less than the distance between the adjacent cuts.

BRIEF DESCRIPTION OF THE DRAWINGS

The invention will now be described in more detail in connection with the attached drawing wherein.

DETAILED DESCRIPTION OF THE PREFERRED EMBODIMENTS

Figure 1:
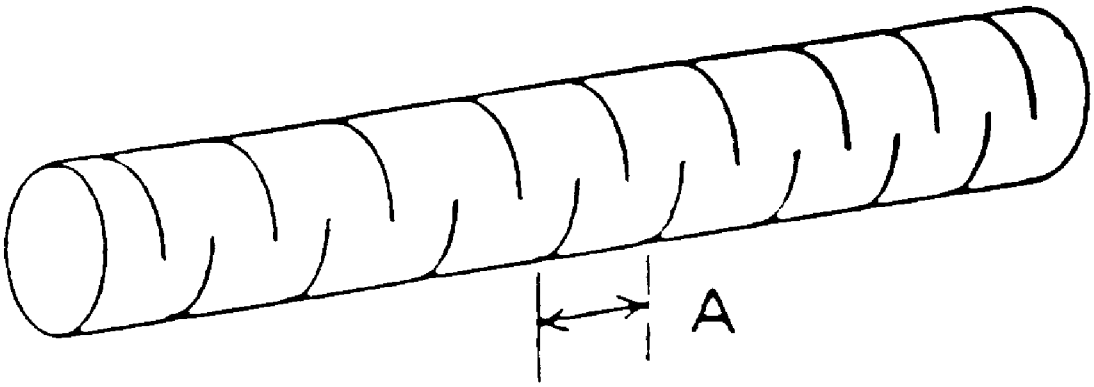
FIG. 1 is a side view of a filter rod according to the present invention.

Tobacco smoke filters are commonly made from cellulose acetate in a form called "cellulose acetate tow." Cellulose acetate tow is a continuous filament band of cellulose acetate fibers. The method of forming cellulose acetate tow is described in U.S. Pat. Nos. 2,953,838 and 2,794,239, which are hereby incorporated by reference. However, a brief discussion of how cellulose acetate tow is formed is appropriate.

It is well known that cellulose acetate is formed from cellulose. Each anhydroglucose unit in a cellulose chain has three hydroxyl groups where ester substitution (such as acetate substitution) may occur. Cellulose esters may be formed by reacting cellulose and an acid anhydride yielding a carboxylic acid and a cellulose ester. The number of carbon atoms in the ester substituent is the same as the number of carbon atoms in the carboxylic acid and is one half the number of carbon atoms in the acid anhydride. This of course assumes that the acid anhydride is symmetrical, having the following form:

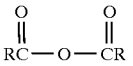

A first step in forming cellulose acetate tow is to mix cellulose pulp derived from wood or cotton fibers with acetic anhydride and acetic acid in the presence of an acid catalyst, such as sulfuric acid. The cellulose and acetic anhydride form cellulose acetate and acetic acid.

In the acylation of cellulose, an average of approximately 2.9 of the 3 available hydroxyl groups are acylated or substituted with the acetate. Next, the polymer is hydrolyzed to the level of substitution of approximately 2.5. Cellulose acetate in a flake form is produced by this process. The cellulose acetate flake is then dissolved in acetone to form a viscous solution. A whitening agent, such as titanium dioxide, is typically added. What results is a liquid "dope".

The dope is filtered and then spun into filaments through an extrusion process by forcing the cellulose acetate solution under high pressure through a spinerette having tiny holes to thereby form individual acetate filaments. The holes in the spinerette may have varying shapes, such as square, triangular and round. Triangular shaped holes result in a trilobal or Y-shaped filament, which has been shown to have a high surface area versus weight, desirable for efficient smoke filtration. After the cellulose acetate solution is pressurized through the spinerette, the fibers fall from the spinerette in fine streams downward through a curing chamber where warm air evaporates the acetone and solidifies the streams of cellulose acetate into separate fiber.

Several thousands of the filaments are combined into a tow band and put through a crimping process. The crimping process is performed by feeding the tow band of uncrimped fibers into a crimping chamber. The tow band is fed into the crimping chamber with feed rollers. The crimping chamber has means for restraining the movement of the tow band out of the crimp chamber which imparts a zig-zag crimp formation to the tow band. The crimping process entangles the fibers and improves the filtration efficiency. However, entangled fibers are also more difficult to disperse.

The crimped tow band is then dried and laid out in a specified pattern to form a bale. The pattern is such that the tow band can be easily pulled out of the bale at a high rate of speed in the future by a customer. The bale is compressed and packed for sale.

It should be noted that the above-described process of forming fibrous cellulose acetate tow may be modified to enhance biodegradability properties. For example, fibers having a lower degree of substitution or acylation are known to degrade at a faster rate, as described in European Patent Publication No. EP-641525, which is hereby incorporated by reference. Also, the process for forming cellulose acetate tow may be modified to add photodegradation enhancing agents, as described in European Patent Publication No. EP 642 604, PCT Patent Publication No. WO 93-24685 and U.S. Pat. Nos. 5,478,386 and 5,491,024, which are hereby incorporated by reference.

The bale which results from the above-described cellulose acetate tow production process may then be used to manufacture filter rods. A filter rod is a wrapped filter element having a length which is usually four or six times the length of an individual filter element attached to a cigarette. Because filter rods have a similar diameter as the cigarettes in which they are used and are covered by white paper, a filter rod closely resemble a cigarette. A process for producing filter rods is described in U.S. Pat. No. 2,900,988, which is hereby incorporated by reference. A general description of the filter rod production process follows.

The cellulose acetate tow is mechanically withdrawn from the bale at a high rate of speed, perhaps several hundreds of meters per minute. The tow is separated into the individual fibers to form a fine ribbon-like tow band which may be one foot wide.

After the cellulose acetate tow is separated into the ribbon-like tow band, a process known as "blooming" is performed on the tow band. During the blooming process, the tow band is deregistered or separated into individual fibers. Blooming can be done by applying differing tensions to adjacent sections of the tow band. In this case, a pretension roller may be used upstream with rollers having grooves being used downstream. Alternatively, the blooming process may be done pneumatically, with air jets. For proper blooming, at least 95% of the fibers should be separated.

After the blooming process, the bloomed tow band passes through a relaxation zone where the fibers can contract, and a portion of the previously imparted crimp can be regained. The relaxed fibers can then pass to a bonding station in which a fiber-to-fiber bonding agent is applied. The bonding agent may be applied in a chamber with a high-speed rotating brush which flings droplets of bonding agent onto the fiber from a reservoir.

Conventionally, a plasticizer was applied as the fiber-to-fiber bonding agent, to bond the bloomed fibers together by solvent bonding. Examples of conventional plasticizers are triacetin (glycerol triacetate), triethylene glycol diacetate and triethyl citrate.

In sufficient quantities, the cellulose acetate fibers dissolve in the conventional plasticizer fiber-to-fiber bonding agent. With the solvent action, the filaments become soft, and at the points where individual filaments touch, the softened surfaces fuse into a homogenous mass. These welded intersections hold the filaments firmly in position relative to adjacent filaments and an overall rigid structure results. Thus, the fiber-to-fiber bonding agent functions to improve filter rigidity, which is a critical requirement for satisfactorily combining the filter with the tobacco column and a critical requirement in providing the smoker with a firm mouthpiece.

The conventional plasticizers have also been found to affect smoke chemistry. The conventional plasticizer fiber-to-fiber bonding agents, such as triacetin, facilitate selective removal of semivolatiles compounds including phenolic compounds. Removal of these components results in a characteristic and desirable taste associated with plasticized cellulose acetate filters.

The conventional plasticizer fiber-to-fiber bonding agents work well for bonding and selective filtration. However, plasticizers in general are not water-soluble, and the fibers will remain bonded over extended periods of time. To address this problem, the present invention employs water-soluble fiber-to-fiber bonding agents, such as water-soluble polymers including polyethers such as polyethylene glycols (also called polyethylene oxides) and polypropylene glycols (polypropylene oxides), polyvinyl alcohols, polyvinyl acetates, water-soluble cellulose esters such as cellulose monoacetates, cellulose ethers, starches, etc. Water-soluble fiber-to-fiber bonding agents based upon water-soluble polymers have been disclosed in U.S. Pat. No. 4,074,724 and European Patent Publication No. EP-634113, which are hereby incorporated by reference. These water-soluble fiber-to-fiber bonding agents increase the rigidity of the resulting filter rod while allowing disintegration in water.

Although the above-described water-soluble polymers function well in fiber bonding, they exhibit no appreciable selective absorption of semivolatiles. To address this problem, the inventors developed a mixed fiber-to-fiber bonding agent formed from a water-soluble polymer with a small amount of triacetin or other selective filtering agent added thereto. Such a fiber-to-fiber bonding agent may have 60–99 wt. % of water-soluble polymer and 40–1 wt. % of selective filtering agent. For example, polyethylene glycol (PEG) with an average molecular weight of 3400 (PEG 3400) may be used with triacetin, with a composition of 90% PEG and 10% triacetin. This mixture is solid at room temperature (25° C.). When melted, this mixture can be applied with the conventional rotating brush system. As the mixture cools on the fibers, the blend solidifies and holds the fibers together, increasing the filter's rigidity. The triacetin comes out of the PEG wax and goes onto the fibers, imparting selective filtration properties. The triacetin does not bond the fibers together, it just modifies the fiber. Thus, the small amount of triacetin does not affect the disintegration properties of the resulting filter rod.

After the fiber-to-fiber bonding agent is applied to the fibers, in a tow condensing and wrapping process, a bundle of fibers is wrapped with paper. To accomplish this, a plug wrap adhesive is applied to one side of a plug wrap paper, and the adhesive treated paper is wrapped around the bundle. The seam of the plug wrap paper is kept hot, and the diameter of the filter rod is precisely controlled to within hundredths of an inch. Then, the seam is cooled using a cooler bar.

Conventionally, a non-water-soluble plug wrap adhesive was used. In the present invention, a water-soluble plug wrap adhesive may be used. For example, two water-soluble adhesives developed by the National Starch Co., which are based upon using starch esters or grafted copolymers, may be used as the plug wrap adhesive. First, as described in U.S. Pat. No. 5,453,144, which is hereby incorporated by reference, blends of grafted copolymers may be used with the addition of trackifying resins, polar waxes, anti-oxidants, and other compatible water-soluble or water-sensitive thermoplastic polymers. An adhesive of this first type is marketed by the National Starch Co. under the trademark CYCLOFLEX 70-3680. Second, as described in U.S. Pat.

No. 5,498,224, which is hereby incorporated by reference, blends of adhesives of the first type with starch esters may be used as water-soluble plug wrap adhesive. Either of these two water-soluble adhesives can be used alone and conceivably, the two could be used together.

After applying the plug wrap paper, the wrapped, condensed and bonded fibers are cut. Conventionally and according to the present invention, the fibers are cut into filter rods, and as mentioned earlier, a filter rod may serve as a filter element for 4 or 6 cigarettes, depending on the length of the filter rod. As the wrapped fibers travel, a continuously sharpened blade moving with the wrapped fibers cuts the wrapped fibers into filter rod segments.

In addition to cutting the wrapped fibers into filter rods, the inventors discovered that water dispersibility and disintegration are strongly related to the individual fiber length. Short fibers disperse more readily than long fibers. To make a water disintegratable filter rod from cellulose acetate fibers, additional cutting is performed. The additional cutting cuts the fibers into the short lengths described below.

The inventors found that it was necessary to cut substantially all fibers. More specifically, at least 95% of the fibers should be cut. However, when cuts are made all the way through the filter rod, it is difficult to reassemble the pieces to form a tobacco smoke filter. This is particularly true when the cuts are close together. In order to cut substantially all fibers without cutting all the way through the wrapped fibers, the present invention provides for a plurality of cuts to be made more than halfway through the filter, from different sides of the filter. FIG. 1 is a diagram illustrating an exemplary cutting pattern. As can be seen, cuts are made from two opposing sides of the wrapped fibers. Other cutting configurations are possible. For example, the cuts could be made from three or more different directions or to different depths, etc. For example, cuts extending more than halfway through the wrapped fibers could be formed from a first direction, and cuts extending less than halfway through the wrapped fibers could be formed from a second, different direction.

The distance A shown in FIG. 1 is critical to dispersion. With longer fiber lengths, the fibers are less likely to disperse. Shorter lengths are preferable, as long as the rigidity is maintained. In the broadest sense, the length A should be less than 10 mm, from 2–10 mm. It is more preferable that the length A is less than 7 mm, from 2–7 mm. Most preferred is the length A of less than 5 mm, from 2–5 mm. At fiber lengths less than 2 mm, rigidity may be lost, cost will be increased, and it does not appear that an improvement in dispersion is achieved.

The additional cuts to the wrapped fibers conceivably could be made at any time after the fibers are wrapped. For example, the wrapped fibers could be partially cut therethrough before the wrapped fibers are cut into filter rods. Alternatively, the individual tobacco smoke filter elements could be partially cut therethrough. However, it appears to be most preferable to perform the partial cutting after the filter rod is cut from the wrapped fibers but before the filter rod is divided into separate tobacco smoke filter elements.

As mentioned above, after a filter rod is formed, it is cut into a plurality of sections. Three sections are common. Tobacco rods are attached to the ends of the sections and each section is cut in two to achieve two cigarettes from the section or perhaps six cigarettes from the filter rod. Each cigarette has a filter element.

It is important that the tobacco paper and other cigarette components dissolve or disintegrate rapidly in water. The paper wrapping the filter fibers is surrounded by another layer of paper called tipping paper, and this paper must release the filter elements held therein. All papers used in the cigarette should disintegrate in water.

In the above-described process for producing a tobacco smoke filter rod according to the claimed invention, there are two parameters which must be carefully controlled. More specifically, "crimp ratio" and "denier per filament," which are discussed below in turn, must be carefully controlled.

Crimping is imparted to the cellulose acetate fibers by forcing the fibers into a crimping chamber during the acetate tow production process. A portion of that crimp will be retained in the final filter rod product. One parameter to evaluate the retained crimp is the "crimp ratio" which is the ratio of fully extended fiber length to relaxed fiber length in the filter rod. Higher crimp ratios in the filter rod result in more bulk, better firmness, more entanglement and better filtration. Because of the additional bulk, less filter material is used, and cost is reduced. The inventors have found that lower crimp ratios are associated with improved filter disintegration.

Crimp ratios in a conventional filter rod are within the range of 1.2 to 1.8. In the present invention, with the 2–10 mm fiber lengths (distance A between adjacent cuts), crimp ratios of 1.1 to 1.8 can be used. In general, a slightly lower than normal crimp ratio should be used to provide adequate disintegration without using exceedingly short fiber lengths. The more preferred crimp ratio is 1.1 to 1.5, and the most preferred crimp ratio is 1.1 to 1.3.

The crimp ratio is determined by production factors during the acetate tow production process and the filter rod production process. During the acetate tow production process, the crimp can be controlled by restricting the movement of the tow out of the crimping chamber. This is normally accomplished through use of a clapper gate arrangement which can be adjusted to inhibit movement of the tow. Manipulating the crimp in the acetate tow production process is described in U.S. Pat. No. 4,395,804, which is hereby incorporated by reference.

Besides the crimp level, "denier per filament" is the other important variable which must be controlled precisely in the filter rod operation process. Denier per filament is a measure of fiber weight. More specifically, denier per filament is defined as the weight in grams for a single fiber filament 9000 meters long. Such a filament may weigh 3 grams, for example. Weight is also measured in "total denier" which is the weight of a 9,000 meter long bundle of fibers. If there are 10,000 fibers in a bundle, with each fiber weighing 3 grams, the total denier would be 30,000. Thus, two variables effect total denier, the denier per filament and the number of filaments in the bundle of fibers.

A smaller denier per filament is preferred because smaller light weight fibers have the advantage of high filtration efficiency, lower weight at a given pressure drop and lower costs because of less material. There are two major disadvantages of a smaller denier per filament. The resulting tobacco smoke filter is less rigid, and the fibers are less likely to disperse in water. Just as a thicker fishing line can be more easily detangled, so too can a thicker cellulose acetate fiber.

Generally speaking, the present invention can use the same denier per filament as is currently being used. For example, a denier per filament in the range of 1.5 to 15 can be used. However, for this invention it is preferable to use a slightly higher denier per filament to enable good firmness and easy disintegration. The more preferred range is 2–10 and the most preferred range is 2 to 4.

Good filter firmness is a further requirement for the present invention. Filter firmness can be measured by a Filtrona hardness test in which a load of 300 grams is placed on a filter by means of a 12-mm diameter round foot, and the amount of deflection is measured. The deflection is subtracted from filter diameter, and this quantity is divided by the filter diameter and multiplied by 100%. The present invention should have a Filtrona hardness of greater than 60%, or preferably greater than 80%, and most preferably greater than 90%.

The present invention is not limited to the type of polymer used to make the fibers, although cellulose acetate is preferred because of smoke taste considerations. A disintegrating filter rod can be made from rayon fibers or other forms of regenerated cellulose, polyethylene fibers, polypropylene fibers, polyethylene terephthalate fibers, polypropylene terephthalate fibers, polyhydroxybutyrate fibers, polyhydroxyvalerbutyrate fibers, or other polymers with properties sufficient to make continuous-filament fibers. In fact, because cellulose acetate softens significantly in water, a synthetic fiber which maintains its stiffness in water could provide a filter rod which disintegrates with longer cut lengths.

The present invention is not limited to the filter configurations. That is, filter rods according to the present invention may have additives such as charcoal, silica or alumina to modify the smoke character, may have varying lengths, thicknesses, ventilation schemes, etc.

With the present invention, an environmentally disintegratable tobacco smoke filter rod and method for producing same are provided. The present invention is useful in removing problems associated with the clean-up of discarded tobacco smoke filters. With the present invention, photo- and bio-degradation of tobacco smoke filter is accelerated because the fibers are rapidly dispersed into a degradation environment. The rate of disintegration can be within seconds of becoming wet, provided that moisture disintegrating paper and tipping paper are used with the present invention.

EXAMPLES

The water dispersibility of filter tips was evaluated with a laboratory water dispersion test. The first step was to soak the filters in water until the plug wrap paper was released by the dissolving of the plug wrap adhesive, typically less than one hour. Next, the test consisted of gently shaking the filters for 5 minutes in a six-inch-diameter No. 4-size sieve which is partially submerged in an oscillating water bath, which allows the loose fibers to separate away from the main cluster of entangled fibers. This sieve has square holes with 4.75-mm sides, which are just smaller than the diameter of conventional cigarette filters. The shaker has a 13-mm diameter circular orbit and is set to oscillate at 85 revolutions per minute producing a gentle wave action. After 5 minutes of shaking, the fibers which do not disperse are collected, dried in an oven at 110° for one hour, reconditioned for at least four hours at 22° C. and 60% relative humidity, and weighted. The weight of fibers not dispersed is subtracted from the initial fiber weight, then divided by the initial weight to determine the water dispersibility.

EXAMPLE 1

Sample filter rods were made from a conventional cellulose acetate tow using water-soluble adhesives and cuts as described below, to demonstrate the ability of the invention to make water disintegratable filter tips. The filter rods were made using cellulose acetate tow with 3.0 denier per filament, Y cross section and 35,000 total denier. This tow as processed into filter rods with an Eastman miniature tow-processing unit that pulled the tow from the bale, bloomed the tow, added the bonding agent, and controlled the delivery of the tow to the plug maker. A Molins PM-2 plug maker wrapped the tow with Ecusta 646 plug wrap paper forming cylinder-shaped rods. Water-soluble materials were used as the fiber-to-fiber bonding agent and as the plug wrap adhesive. The fiber bonding agent consisted of a blend of 90 wt. % PEG3400 wax and 10 wt % triacetin. This water-soluble bonding agent was applied at the 37 wt % level to the bloomed tow with the conventional rotating-brush applicator system by heating the bonding agent to 80° C. The bonding agent and tow were kept hot by using appropriately placed laboratory heat guns to heat the delivery rolls and other components that the tow touched before conversion into filter rods. The plug wrap adhesive was CYCLOFLEX 70-3680 from National Starch Co., which was applied with the conventional hot-melt applicator by heating to 325° C. The uncut filter rods were 108-mm in length and had a very good Filtrona hardness of 95%. The rods had an encapsulated pressure drop of 342 mm of water and a circumference of 23.7 mm. The calculated crimp ration was 1.24.

The sample tips were made by modifying the filter rods according to the invention, as illustrated in FIG. 1, with the various cut lengths to demonstrate the effect of cut created lengths on the water dispersion of fibers. Results are shown in Table I. Sample A was made by cutting a filter rod into 27-mm tips to make control filters. These sample tips were determined to have no water dispersibility, with the highly entangled fibers looking like a wet cotton ball in the water bath. Sample B was made by cutting a filter rod into 27-mm tips with a cut created length of A≦5-mm, by making ten alternating offset partial cuts at 2.25, 5, 7.25, 10, 12.25, 15, 17.25, 20, 22.25 and 25 mm. Sample C was made by cutting a filter rod into 27-mm tips with a cut created length of A≦4-mm, by making thirteen partial cuts at 1.5, 3.5, 5.5, 7.5, 9.5, 11.5, 13.5, 15, 17.5, 19, 21.5, 23 and 25.5 mm. Sample D was made by cutting a filter rod into 27-mm tips with a cut created length of A≦3-mm, by making seventeen partial cuts at 1.5, 3, 4.5, 6, 7.5, 9, 10.5, 12, 13.5, 15, 16.5, 18, 19.5, 21, 22.5, 24 and 25.5 mm. The results from these samples illustrate the need for short cut created lengths for effective water disintegration.

TABLE I

Example Filter Tips Made with 3/Y/35,000 Tow

| Sample | Cut Created Length, mm | Water Dispersibility, % |
|---|---|---|
| A | 27 | <10 |
| B | 5 | <10 |
| C | 4 | 48 |
| D | 3 | 100 |

Example II

These sample filter rods were made from an uncommon cellulose acetate tow using water-soluble adhesives and cuts as described below, to demonstrate the effect of denier per filament and total denier on filter properties. The filter rods were made using cellulose acetate tow with 8.0 denier per filament, Y cross section and 64,000 total denier. This tow was processed as described in Example I. A similar blend of PEG3400 and triacetin was used as the water-soluble fiber-to-fiber bonding agent and was added to the fibers at the 13 wt % level. The uncut filter rods were 108-mm in length and had a very good Filtrona hardness of 95%. The rods had an encapsulated pressure drop of 312 mm of water and a circumference of 24.7 mm. The calculated crimp ratio was 1.18.

The filter rods were modified according to the invention as illustrated in FIG. 1 with the various cut lengths to demonstrate the effect of cut created lengths on water dispersion of these heavier fibers. Sample E was a control sample make by cutting the rod into 27-mm tips. The sample tips was determined to have no water dispersibility, with the highly-entangled fibers looking like a wet cotton ball in the water bath. Sample F was made by cutting a 27-mm tip to a cut created length of A≦5-mm, by making ten alternating offset partial cuts at 2.25, 5, 7.25, 10, 12.25, 15, 17.25, 20, 22.25 and 25 mm. Sample G was made by cutting a 27-mm tip with a cut created length of A≦4-mm, by making thirteen partial cuts at 1.5, 3.5, 5.5, 7.5, 9.5, 11.5, 13.5, 15, 17.5, 19, 21.5, 23 and 25.5 mm. Sample H was made by cutting a 27-mm tip to a cut created length of A≦3-mm, by making seventeen partial cuts at 1.5, 3, 4.5, 6, 7.5, 9, 10.5, 12, 13.5, 15, 16.5, 18, 19.5, 21, 22.5, 24 and 25.5 mm. The results shown in Table II illustrate that larger denier per filament fibers can allow one to use longer cut created lengths.

TABLE II

Example Filter Tips Made with 8/Y/64,000 Tow

| Sample | Cut Created Length, mm | Water Dispersibility, % |
|---|---|---|
| E | 27 | <10 |
| F | 5 | 81 |
| G | 4 | 100 |
| H | 3 | 100 |

While the invention has been described in connection with the preferred embodiments, it will be understood that modifications within the principle outlined above will be evident to those skilled in the art. Thus, the invention is not limited to the preferred embodiments, but is intended to encompass such modifications.

What is claimed is:

1. A tobacco smoke filter rod comprising a bundle of wrapped fibers with a plurality of cuts extending more than half way through the bundle without extending completely through the bundle, the tobacco smoke filter rod being prepared such that:

(A) the retained crimp ratio is in the range of 1.1 to 1.8, (B) the average denier per filament of the fibers is in the range of 1.5 to 15, (C) the cut created length of at least 95% of the fibers is less than 10 mm, and (D) a sufficient number of the fibers are bound with a water-soluble solid bonding agent to create a Filtrona hardness of greater than 60%.

2. A tobacco smoke filter rod comprising a bundle of wrapped fibers with a plurality of cuts extending more than half way through the bundle without extending completely through the bundle, the tobacco smoke filter rod being prepared such that:

(A) the retained crimp ratio is in the range of 1.1 to 1.5, (B) the average denier per filament of the fibers is in the range of 2 to 10, (C) the cut created length of substantially all of the fibers is in the range of 2 to 7 mm, and (D) a sufficient number of fibers are bound with a water-soluble solid bonding agent to create a Filtrona hardness of greater than 80%.

3. A tobacco smoke filter rod comprising a bundle of wrapped fibers with a plurality of cuts extending more than half way through the bundle without extending completely through the bundle, the tobacco smoke filter rod being prepared such that:

(A) the retained crimp ratio is in the range of 1.1 to 1.3, (B) the average denier per filament of the fibers is in the range of 2 to 4, (C) the cut created length of substantially all of the fibers is in the range of 2 to 5 mm, and (D) greater than 95% of the fibers are bound with a water-soluble solid bonding agent to create a Filtrona hardness of greater than 90%.

4. A tobacco smoke filter rod according to claim 1, wherein the fibers in the bundle of wrapped fibers are cellulose acetate fibers.

5. A tobacco smoke filter rod according to claim 1, wherein the plurality of cuts extending more than one half way through the bundle are formed from a plurality of different directions.

6. A tobacco smoke filter rod according to claim 5, wherein for each of the plurality of different directions, there is a distance between adjacent cuts made from the direction, the distance between adjacent cuts being in the range of 2 to 7 mm.

7. A tobacco smoke filter rod according to claim 1, wherein the cuts extending more than one half way though the bundle are formed from a first direction, the bundle of fibers further having a plurality of cuts extending less than one half way through the bundle formed from a second direction, different than the first direction.

8. A tobacco smoke filter rod according to claim 7, wherein for each of the first and second directions, there is a distance between adjacent cuts made from the direction, the distance between adjacent cuts being in the range of 2 to 7 mm.

9. A tobacco smoke filter rod according to claim 1, wherein the water-soluble fiber-to fiber bonding agent includes 60–99 wt. % of a water-soluble binder and 40–1 wt. % of a plasticizer.

10. A tobacco smoke filter rod according to claim 1, wherein the water-soluble fiber-to fiber bonding agent is a mixture of a water-soluble polymer and glycerol triacetate.

11. A tobacco smoke filter rod according to claim 1, wherein the bundle of wrapped fibers is formed from fibers wrapped in a paper having opposing ends secured together with a water-soluble plug wrap adhesive.

12. A tobacco smoke filter rod according to claim 2, wherein the fibers in the bundle of wrapped fibers are cellulose acetate fibers.

13. A tobacco smoke filter rod according to claim 3, wherein the fibers in the bundle of wrapped fibers are cellulose acetate fibers.

14. A tobacco smoke filter rod according to claim 2, wherein the plurality of cuts extending more than one half way through the bundle are formed from a plurality of different directions.

15. A tobacco smoke filter rod according to claim 3, wherein the plurality of cuts extending more than one half way through the bundle are formed from a plurality of different directions.

16. A tobacco smoke filter rod according to claim 2, wherein the cuts extending more than one half way though the bundle are formed from a first direction, the bundle of fibers further having a plurality of cuts extending less than one half way through the bundle formed from a second direction, different than the first direction.

17. A tobacco smoke filter rod according to claim 3, wherein the cuts extending more than one half way though the bundle are formed from a first direction, the bundle of fibers further having a plurality of cuts extending less than one half way through the bundle formed from a second direction, different than the first direction.

18. A tobacco smoke filter rod according to claim 2, wherein the water-soluble fiber-to fiber bonding agent includes 60–99 wt. % of a water-soluble binder and 40–1 wt. % of a plasticizer.

19. A tobacco smoke filter rod according to claim 3, wherein the water-soluble fiber-to fiber bonding agent includes 60–99 wt. % of a water-soluble binder and 40–1 wt. % of a plasticizer.

20. A tobacco smoke filter rod according to claim 2, wherein the water-soluble fiber-to fiber bonding agent is a mixture of a water-soluble polymer and glycerol triacetate.

21. A tobacco smoke filter rod according to claim 3, wherein the water-soluble fiber-to fiber bonding agent is a mixture of a water-soluble polymer and glycerol triacetate.

22. A tobacco smoke filter rod according to claim 2, wherein the bundle of wrapped fibers is formed from fibers wrapped in a paper having opposing ends secured together with a water-soluble plug wrap adhesive.

23. A tobacco smoke filter rod according to claim 3, wherein the bundle of wrapped fibers is formed from fibers wrapped in a paper having opposing ends secured together with a water-soluble plug wrap adhesive.

* * * * *